US008240262B2

(12) United States Patent
Zeiger et al.

(10) Patent No.: US 8,240,262 B2
(45) Date of Patent: Aug. 14, 2012

(54) METHOD AND DEVICE FOR DISPLAYING SEWING PROCESSES

(75) Inventors: Stefan Zeiger, Zurich (CH); Boris Zickenberg, Aach (DE)

(73) Assignee: BERNINA International AG, Steckborn (CH)

( * ) Notice: Subject to any disclaimer, the term of this patent is extended or adjusted under 35 U.S.C. 154(b) by 1059 days.

(21) Appl. No.: 11/751,060

(22) Filed: May 21, 2007

(65) Prior Publication Data

US 2008/0006192 A1 Jan. 10, 2008

(30) Foreign Application Priority Data

Jul. 10, 2006 (CH) ..... 1099/06

(51) Int. Cl.
*D05B 19/00* (2006.01)

(52) U.S. Cl. ..... 112/470.01; 112/470.04; 700/136

(58) Field of Classification Search ..... 112/470.01, 112/470.04, 475.01, 475.18, 475.19, 102.5; 700/136, 138

See application file for complete search history.

(56) References Cited

U.S. PATENT DOCUMENTS

| | | | | |
|---|---|---|---|---|
| 4,860,675 | A * | 8/1989 | Brower et al. | 112/470.06 |
| 4,901,656 | A * | 2/1990 | Yoshida | 112/470.01 |
| 5,799,599 | A * | 9/1998 | Tsukioka et al. | 112/65 |
| 5,983,817 | A * | 11/1999 | Sekine | 112/102.5 |
| 7,278,362 | B2 * | 10/2007 | Hirata et al. | 112/470.04 |
| 2004/0222993 | A1 * | 11/2004 | Kaasa et al. | 345/474 |

OTHER PUBLICATIONS

Secrets of Embroidery, Basic Sewing, Jun. 23, 2006, http://www.secretsof.com/content/2748.*

* cited by examiner

*Primary Examiner* — Nathan Durham
(74) *Attorney, Agent, or Firm* — Volpe and Koenig, P.C.

(57) ABSTRACT

A method and the device for displaying sewing processes to allow simulation of the formation of stitch patterns and embroidery patterns in sewing machines (1) and embroidery machines or in sewing simulators close to reality is provided. In the representation on the monitor (3) features, such as colors and the structure of the sewing material (2), are considered. By activating a simulation mode, the drive for the stitch formation unit can be disabled.

9 Claims, 3 Drawing Sheets

METHOD AND DEVICE FOR DISPLAYING SEWING PROCESSES

CROSS-REFERENCE TO RELATED APPLICATIONS

This application claims the benefit of Swiss Patent Appln. No. 01099/06, filed Jul. 10, 2006, which is incorporated herein by reference as if fully set forth.

BACKGROUND

The invention is directed to a method and a device for displaying sewing processes.

Modern sewing machines and embroidering machines generally comprise a monitor. This may be used for displaying information and (in case of touch screens) for operating or controlling the sewing machine. In particular, it is known to display small images and/or icons of embroidery patterns to be selected on touch-sensitive screens.

From U.S. Pat. No. 5,983,817 a sewing machine with a connectable control device is known. It comprises a personal computer as a control device, having a monitor and input devices for a menu controlled adjustment of various parameters, among other things, for example embroidery patterns may be selected, and for controlling the sewing machine. When the control device does not recognize a connected sewing machine the simulation mode is activated. Here, pseudo signals are created, which are equivalent to the signals created by a sewing machine during the sewing process.

In prior art, the complete stitching and embroidery patterns are each displayed on the monitor. In particular for more complex patterns the individual stitching sites and the sequence of the needle stitches in the sewing material and/or the development process of stitching and embroidery patterns displayed on the monitor are hardly discernible or not at all. Furthermore, such conventional representations do not reflect the actual conditions, because neither color nor structure of the sewing material, nor the colors of the needle thread and the bottom thread are considered.

SUMMARY

The object of the present invention is to provide a method and a device for a representation close to reality and/or equivalent to reality and/or to create a simulation of sewing and embroidery processes.

This object is attained in a method and a device for showing sewing processes according to the invention.

Using the method according to the invention and the device according to the invention, the development process of stitching patterns and embroidery patterns are shown in a manner close-to-reality and/or equivalent to reality on a preferably high-resolution monitor (for example on a section of the sewing machine monitor or on the monitor of a simulator and/or a computer running a simulation software). The color and, if applicable, also the structure of the section of the monitor showing the sewing material may be selected, depending on the embodiment of the invention, from a number of stored image samples (e.g., bitmap-samples), or directly be detected at the respective sewing material via a camera or a color sensor. Similarly, the colors and the thickness of the needle thread and the bottom thread may also be predetermined. In an advantageous embodiment of the invention the visualization of the sewing or knitting process may optionally occur during the actual operation of the sewing and/or embroidery machine or when the simulation mode is activated. In the simulation mode the stitch formation in the sewing material is prevented, for example by decoupling the needle rod from the primary drive, or by the primary drive of the sewing machine remaining switched off. For a rather realistic display of a sewing or embroidery image and its development it is therefore not necessary to sew a sample pattern onto the actual original material. For visualizing a sewing or embroidering process, for example the control values of the motors and/or the steppers can be detected, which are used to create the respective stitching or embroidering pattern, thus for example the control values of the stepper for longitudinal and lateral transport as well as for the width of the stitch and/or the motion of the needle rod.

When the sewing material is moved via transporters additionally the slip-features of the sewing material can be considered in the form of slip-factors for forward, reverse, right, and left motion. When displaying the "virtual" sewing image on the monitor, these slip-factors compensate the difference between the drive motions of the transporter and the motion of the actual material. Such slip-factors and, perhaps additional factors, can for example be entered into the sewing machine control in an initialization routine.

When using embroidery frames for moving the sewing material no slip-correction factors are necessary.

In addition to the visualization of the creation of stitch and embroidery patterns, for example the creation of button holes as well as the insertion of buttons or stitching images created by special needles can also be simulated in the sewing material.

BRIEF DESCRIPTION OF THE DRAWINGS

In the following, the invention is explained in greater detail using the drawing figures. Shown are.

DETAILED DESCRIPTION OF THE PREFERRED EMBODIMENTS

Figure 1:
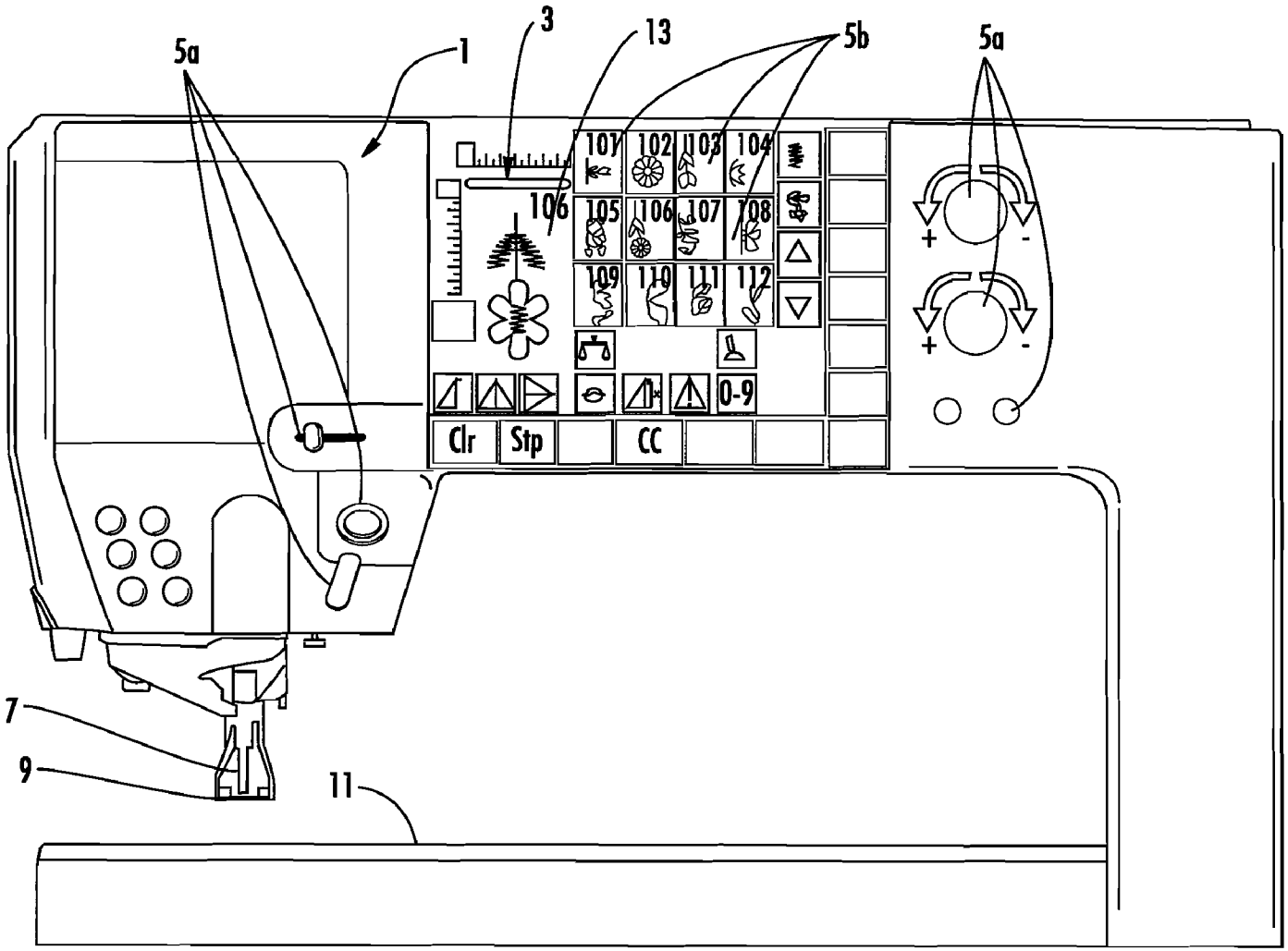
FIG. 1 is a partial view of a sewing machine with a monitor.

FIG. 1 shows a partial view of a sewing machine 1 with a machine monitor, called monitor 3 for short. The monitor 3 comprises a touch-sensitive monitor (also called "touch screen" or "sensor monitor"). The sewing machine 1 comprises fixed operating elements 6*a*, e.g., in the form of actual buttons, rotary knobs, and regulators. On the monitor 3, which serves as a user interface, e.g., depending on the respective configuration of the sewing machine 1, information and selection options may be displayed. In the example in FIG. 1, a selection menu for different sewing stitches is shown on monitor 3. Here, the individual stitching patterns may be selected via variable and/or virtual operating elements 5*b*, which are displayed on the monitor, for example in the form of buttons or operating fields with a small, mostly simplified image or icon of the respective stitch type. The virtual buttons for selecting the stitch type additionally comprises a number for a definite identification of the respective stitching pattern.

Depending on the respective configuration of the sewing machine 1, only a part of all available stitching patterns can be used, for example the sewing needle 7 inserted in the needle holder, the pressure foot 9 connected to the material pressure rod, and the stitching plate 11 used. Therefore, it may be provided that each stitching pattern, which cannot be used in the respective configuration, cannot be activated in said configuration and/or is marked as a non-usable stitch type, for example, by displaying it in a different color.

On one part of the monitor 3, a selection window 13 may be shown for an enlarged display of the respectively selected stitch patterns. In a sufficient resolution of the monitor 3 the individual stitching sites 8 and/or points of the sewing needle 7 can also be shown in the display window 13.

Figure 3C:
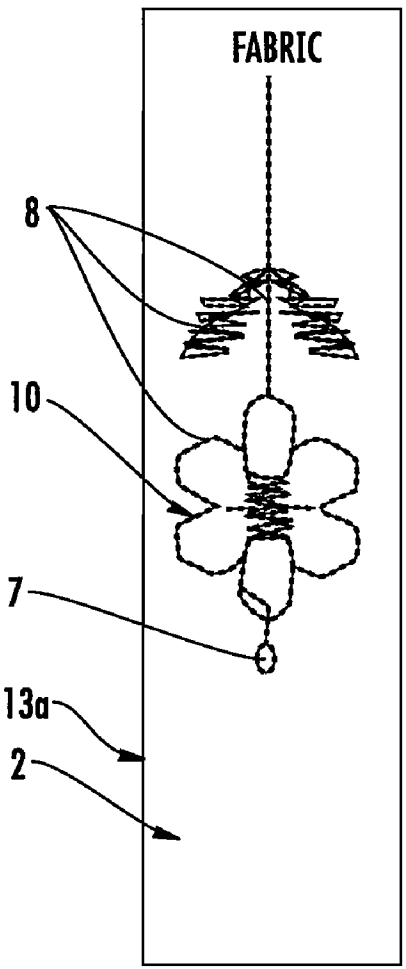
FIG. 3*c* is a third partial image for showing the sewing process.
Figure 3B:
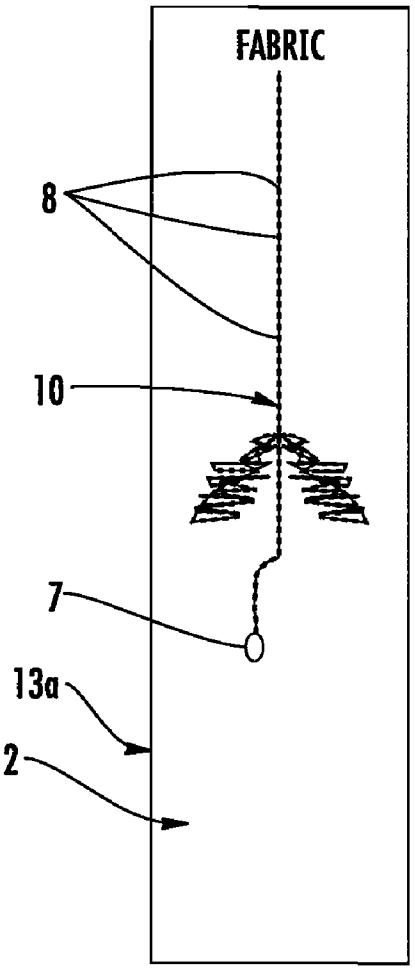
FIG. 3*b* is a second partial image for showing the sewing process.
Figure 3A:
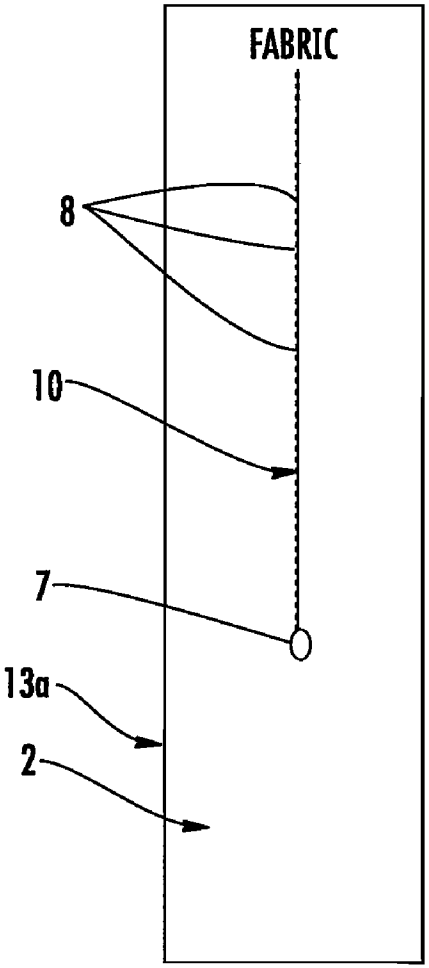
FIG. 3*a* is a first partial image for showing a sewing process.

The information regarding the individual stitching patterns, i.e. for example the absolute or mutually relevant position of individual stitch positions as well as their sequence are stored in a memory (not shown) accessible in a sewing machine control. In an advantageous embodiment of the sewing machine 1 information regarding the characterization of the sewing material 2 to be processed (FIGS. 3*a*, 3*b*, and 3*c*) and/or the needle thread and/or the bottom thread may also be saved in a suitable digitized form. Such information is, for example, color and/or structure of the sewing material 2, color of the bottom thread, slip features of the sewing material 2 and/or correction values for the transportation of the sewing material 2 via a transporter. In such correction values or factors the slippage of the sewing material 2 is compensated in each sewing direction such that the actual stitch positions 8 of the sewing needle 7 into the sewing material 2 is equivalent to the predetermined target values.

The visualization software also comprises a configuration menu, which serves to determine the parameters that influence the stitch pattern.

In order to determine the color and structure of the sewing material 2, a camera (not shown) may be provided, which e.g., is provided at the sewing machine head or can be effectively connected to the sewing machine 1 via an appropriate interface. The detection and storage of an image of the sewing material surface can occur, for example by operating a button temporarily displayed on the touch-screen 3.

Alternatively a limited number of colors and structures can also be stored in the sewing machine memory and/or in a memory allocated to the sewing machine 1, e.g., in form of a bitmap, with then each color and patterns being selected most closely resembling the actual sewing material. The features of the virtual sewing material 2 are therefore approximated, adjusted, or assimilated to the features of the real sewing material 2.

The detection of the sewing material color or the color of the needle and the bottom thread can alternatively also occur via a color sensor.

If necessary, additional features of the sewing material 2, such as elasticity and structure and/or features of sewing machine elements, such as e.g., the type of sewing needle used can also be determined in the configuration menu by selecting it from a number of predetermined, saved parameters. Instead of a manual configuration devices for an automatic detection of one or more such parameters may also be provided. A sewing needle 7 and/or other sewing machine elements can be provided with a code, for example with a color code or barcode or another touchlessly detectable code, which for example can be stored on a RFID-marker. Alternatively, codes that can be mechanically scanned may be provided. When such codes are automatically detected, the sewing machine control and/or the software for visualizing the sewing processes can recall the allocated stored information and automatically configure the respective elements.

The sewing machine 1 comprises a real or a virtual operating element 6*a*, 5*b* for switching between the normal sewing mode, in which the stitching pattern is sewn onto the sewing material 2 under the sewing needle 7, and a simulation mode.

In the simulation mode, for example the primary motor of the sewing machine 1 is switched off or the needle rod is decoupled from the needle rod drive such that when operating the foot control or an appropriate other operating element 6*a*, 5*b* no real stitch formation occurs in the sewing material 2. In this operating mode the stitch formation process is displayed on the monitor 3. Here, the sewing needle 7, its stitch sites 8 into the sewing material 2, and the previously formed seam 10 between the stitching sites 8 are visible. In the FIGS. 3*a*, 3*b*, and 3*c*, each section of the sewing material 2 shown for illustrating the sewing process during the production of a stitch pattern with a simple sewing needle 7 is displayed on the monitor 3 temporarily offset. Alternatively, the overall stitching or embroidery pattern shall be displayed with reduced intensity as a background on the monitor 3 and/or in a display window 13 of the monitor 3. Then, during the simulation of the sewing process the actual position of the sewing needle 7 and the already formed part of the seam 10 are shown emphasized.

When using special needles, such as triple needles or sword needles, these needles and the corresponding stitch patterns and seams are shown close to reality on the monitor 3 similar to the sewing process using a sewing needle 7.

The speed of this virtual sewing process is preferably adjustable or changeable via the foot control or the operating element 6*a*, 5*b* provided therefor. In particular, in the simulation the stopping and the change or direction of the virtual sewing process may be provided. This way the creation process of a stitch pattern and its effect on the sewing material 2 can be better understood and evaluated. In a particular advantageous embodiment of the invention, additional parameters, such as thread tension and material type can be predetermined and considered. In the memory of the sewing machine 1 various features, such as thickness or slippage factors can be stored for different types of materials. When the knot formation between the bottom thread and the needle thread occur based on such factors above the sewing material 2, this can be considered in the simulation of the sewing process, in which the knots and the sections of the bottom thread visible from above are shown as well.

The visualization software can optimally be embodied for showing additional processes, such as e.g., the production of button holes. After the completion of the frame of the button hole, then the production of the cutting gap is virtually shown on the monitor 3. Subsequently then, for example by menu control, an appropriate button is selected from a number of stored buttons and virtually guided through the button hole (not shown). Preferably only the buttons fitting to the size of the respective button hole can be selected. Images of buttons can stored as bitmap similar to the sewing material 2. Such images can e.g., be transferred via internet or via data carriers to the memory accessible from the sewing machine control.

In the normal sewing mode, different from the simulation mode, the stitch formation device is activated so that the sewing pattern can be sewn onto the real sewing material 2. Optionally here the seam formation process may or may not be visualized similar to the simulation mode on the monitor 3.

Instead of a transporter, an embroidery frame (not shown) can also be used for displacing the sewing material 2 in the sewing level. Due to the fact that the sewing material 2 is stretched in the embroidery frame, in this case no slippage related stitching errors can occur. Using an embroidery frame not only small stitching patterns but also larger stitching patterns can be created. Alternatively, other transportation devices can be used for a displacement and/or positioning of the sewing material in reference to the stitch formation device, for example roller drives, as used in the larger quilting devices. The visualization explained using the stitch patterns respectively applies for the embroidery patterns as well. In the present document the term "sewing machine 1" also includes other stitch forming machines, in particular embroidery machines or sewing machines 1 with an embroidery frame.

Figure 2:
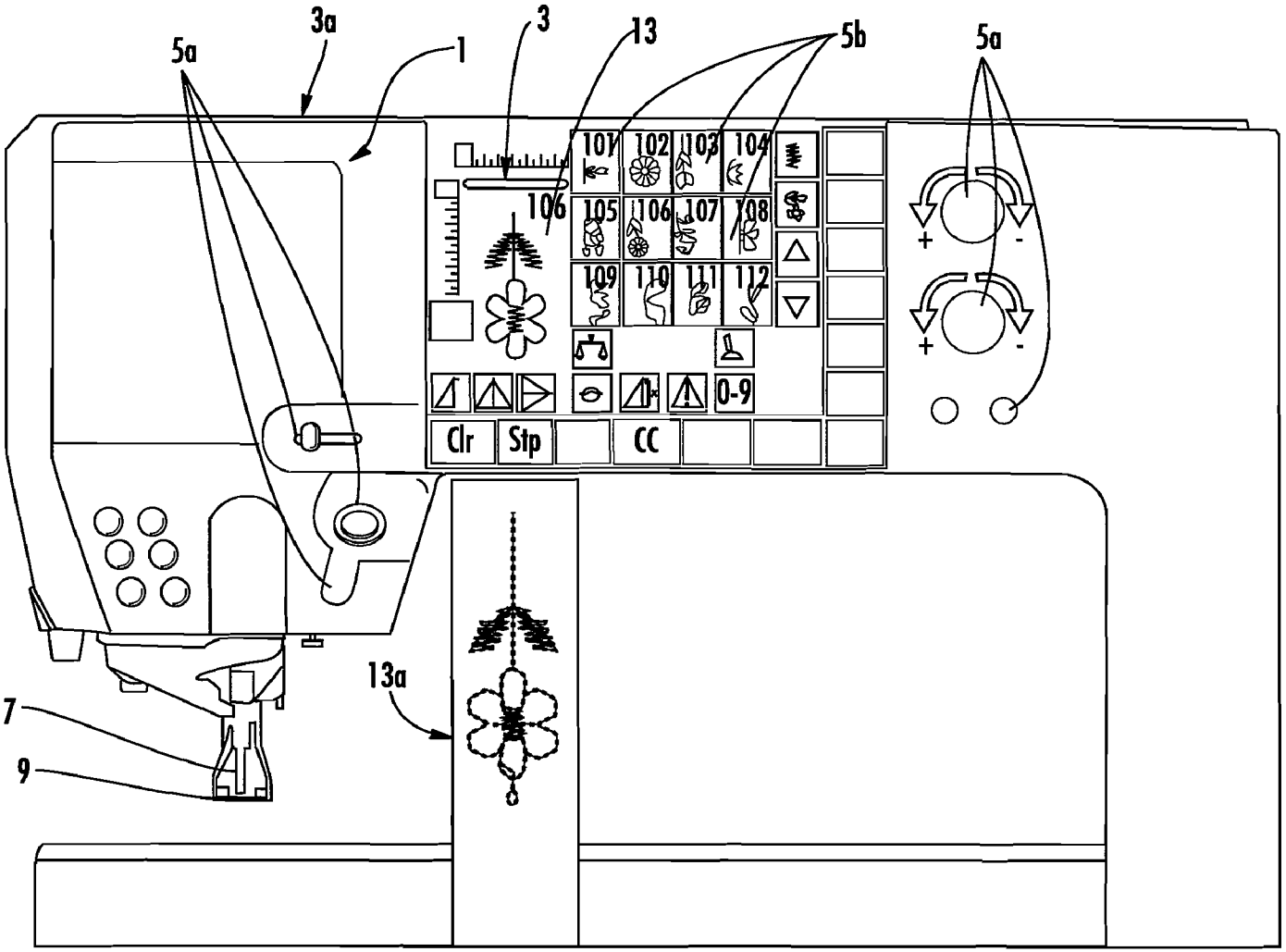
FIG. 2 is a representation of the sewing machine of FIG. 1 on the monitor of a simulator.

Sewing and embroidery processes can alternatively also be simulated on a simulator and/or a computer and visually displayed on a simulator monitor 3*a*, as shown in FIG. 2. On the simulator monitor 3*a* essentially the sewing machine 1 of FIG. 1 is shown, in which additional display windows 13 may be displayed with information, status displays, and virtual operating elements 5*b*. In particular, a simulation window 13*a* is shown between the upper arm and the lower arm, in which the creation process of the stitch or embroidery pattern is shown close to reality. The finished stitching or embroidery pattern is here shown not as an interference. The sewing material 2 is shown as a background with the respective bitmap pattern in the simulation window 13*a*. The sewing needles 7 are visible as well as the already sewn section of the seam 10 (essentially the needle thread) with the respective stitching sites 8 in the sewing material 2.

LIST OF REFERENCE CHARACTERS

1 sewing machine
2 sewing material
3 monitor
3*a* simulation monitor
5*a* fixed operating elements
5*b* virtual operating elements
7 sewing needle
8 stitching sites
9 pressure foot
10 seam
11 stitching plate
13 display window
13*a* simulation window

The invention claimed is:

1. A method for showing sewing processes in sewing machines (1) or sewing simulators, comprising:

at least one of selecting or adjusting a parameter for a desired sewing process, showing a virtual sewing material (2) on at least one of a monitor (3) or a simulator monitor (3*a*), creating a user directed virtual seam (10) on the virtual sewing material (2) according to the at least one of the selected or adjusted parameter by way of repeatedly inserting a virtual sewing needle (7) with relative motions executed between the virtual sewing material (2) and the virtual sewing needle (7) while no movement of an actual needle to create stitches occurs.

2. A method according to claim 1, wherein at least one feature of the virtual sewing material (2) is approximated, adjusted, or assimilated to a respective feature of actual sewing material (2).

3. A method according to claim 2, further comprising approximating, adjusting or assimilating colors of a needle thread and a bottom thread of the virtual seam (10) to a color of a needle thread and a bottom thread of an actual seam (10).

4. A method according to claim 2, wherein at least a part of the at least one feature of at least one of the virtual sewing material (2) or the virtual seam (10) is detected automatically.

5. A method according to claim 1, wherein a primary drive or power transmission from the primary drive to a needle rod in sewing machines (1) is deactivated by activation of a simulation mode.

6. A method according to claim 1, further comprising controlling the virtual sewing process using a foot control or by another operating element (5*a*, 5*b*).

7. A method according to claim 6, wherein at least one of a sewing speed or a sewing direction is influenced by the operating element (5*a*, 5*b*).

8. A method according to claim 1, wherein in addition to the simulation of the sewing process, other processes are simulated.

9. A method according to claim 8, wherein the other processes comprise production of a button hole and fastening a button for a button hole.

* * * * *